US005348173A

United States Patent [19]

Norwood

[11] Patent Number: 5,348,173

[45] Date of Patent: Sep. 20, 1994

[54] COLLAPSIBLE-STACKABLE PLASTIC CONTAINER

[76] Inventor: Peter M. Norwood, 600 Plaza Middlesex, Middletown, Conn. 06457

[21] Appl. No.: 763,255

[22] Filed: Sep. 20, 1991

[51] Int. Cl.[5] ..... B65D 1/02; B65D 21/08; B65D 23/00

[52] U.S. Cl. ..... 215/10; 215/16; 206/509; 220/666

[58] Field of Search ..... 215/16, 10; 220/666, 220/906, 672, 23.4; 222/95, 104, 105, 107, 529; 206/218, 509; 323/120

[56] References Cited

U.S. PATENT DOCUMENTS

| | | | |
|---|---|---|---|
| 2,911,972 | 11/1959 | Elinger | 215 1 C/ |
| 3,369,687 | 2/1968 | Walls | 215/10 |
| 3,485,355 | 12/1969 | Stewart | 215/10 X |
| 3,559,847 | 2/1971 | Goodrich | 222/107 |
| 3,623,634 | 11/1971 | Norgard | 215/10 |
| 3,939,887 | 2/1976 | Scarnato | 220/666 |
| 3,939,888 | 2/1976 | Scarnato | 220/906 X |
| 4,127,207 | 11/1978 | Hubert et al. | 215/1 C |
| 4,308,955 | 1/1982 | Schifser et al. | 215/10 X |
| 4,316,551 | 2/1982 | Belokin,Jr. | 220/906 X |
| 4,386,701 | 6/1983 | Galer | 215/10 X |
| 4,492,313 | 1/1985 | Touzani | 215/1 C |
| 4,492,324 | 1/1985 | Weber | 222/529 |
| 4,603,791 | 8/1986 | Spierer et al. | 220/94 A X |
| 4,691,828 | 9/1987 | Slusarczyk | 215/10 X |
| 4,735,313 | 4/1988 | Schoenberg | 220/94 A X |
| 4,775,564 | 10/1988 | Shriver et al. | 220/666 X |
| 4,790,361 | 12/1988 | Jones et al. | 220/666 |
| 4,793,516 | 12/1988 | Niwa et al. | 215/10 X |
| 4,805,788 | 2/1989 | Akiho | 220/675 |
| 4,805,793 | 2/1989 | Brandt et al. | 215/1 C X |
| 4,865,211 | 9/1989 | Hollingsworth | 215/1 C X |
| 4,873,100 | 10/1989 | Dirksing et al. | 215/1 C X |
| 4,921,147 | 5/1990 | Poirier | 220/666 |
| 4,955,493 | 9/1990 | Touzani | 220/666 X |
| 5,002,193 | 3/1991 | Touzani | 220/666 X |
| 5,002,199 | 3/1991 | Frahm | 215/1 C X |
| 5,114,011 | 5/1992 | Robbins, III | 215/1 C X |
| 5,154,295 | 10/1992 | Stoner | 220/23.4 |
| 5,224,613 | 7/1993 | Robbins, III | 220/666 X |

FOREIGN PATENT DOCUMENTS

| | | | |
|---|---|---|---|
| 1271144 | 7/1990 | Canada | 220/666 |
| 2541580 | 3/1977 | Fed. Rep. of Germany | 215/10 |
| 3443423 | 5/1986 | Fed. Rep. of Germany | 206/509 |
| 2207065 | 6/1974 | France | 215/10 |
| 2266641 | 10/1975 | France | 215/6 |
| 2467146 | 5/1981 | France | 215/1 C |
| 2429163 | 2/1990 | France | 206/509 |
| 8805014 | 7/1988 | PCT Int'l Appl. | 220/666 |
| 9008698 | 8/1990 | PCT Int'l Appl. | 220/666 |

*Primary Examiner*—Sue A. Weaver
*Attorney, Agent, or Firm*—C. G. Nessler

[57] ABSTRACT

A stackable collapsible container has a sidewall comprised of opposing conical sections. The upper conical section has a greater length and slighter angle than the lower conical section. Upon application of vertical force the lower section folds under the upper section, so the container assumes a stable collapsed state; and likewise, the necked conical top collapses to further reduce the overall length. The top of a collapsed container has a groove, so that when the top is mated to a ringed recess in a like second container, the containers resiliently lock to each other and thus may be readily stacked.

6 Claims, 4 Drawing Sheets

COLLAPSIBLE-STACKABLE PLASTIC CONTAINER

FIELD OF INVENTION

The invention relates to collapsible containers, especially those which connect to one another for stacking when collapsed.

BACKGROUND

There are increasing environmental and governmental requirements for recyclying plastic containers, such as those conventionally used for foodstuffs and beverages. Thus, a consumer must save used containers and return them to a recycling depot.

However, conventional empty plastic containers are bulky to store and handle, consuming a lot of space. They do not stack readily. If a consumer attempts to collapse such containers he encounters great difficulty in that the containers are resilient and tend to re-assume their original shape. Even if they deform, it is with an irregular shape and they still are not readily storable or stackable. As a result there is a need for collapsible and stackable containers, so that are encouraged to recycle.

There is considerable patent art relating to collapsible containers in general. Among them are Shriver in U.S. Pat. No. 4,775,564; Jones et. al U.S. Pat. No. 4,790,361; Akiho U.S. Pat. No. 4,805,788; Hollingsworth U.S. Pat. No. 4,865,211; Dirksing et al. U.S. Pat. No. 4,873,100; and Touzani U.S. Pat. No. 5,002,193. While there are a variety of wall configurations, many of the prior art containers do not collapse to a stable collapsed state; others have complicated geometry.

There is also considerable patent art relating to the stacking of containers. Among these are Stewart U.S. Pat. No. 3,458,355; Hubert et al. U.S. Pat. No. 4,127,207; Schieser et al. U.S. Pat. No. 4,208,955; Niwa et al. U.S. Pat. No. 4,793,516; Brandt et al. U.S. Pat. No. 4,805,793; and Frahm U.S. Pat. No. 5,002,199. While there are many ways for stacking containers in the prior art most art is directed to conventional containers. There appears to have been little effort addressed to the problem of stacking collapsed containers.

SUMMARY OF THE INVENTION

An object of the invention is to provide a container which collapses to a stable state. A further object of the invention is to provide a collapsible container which in its collapsed state is readily stackable and storable.

According to the invention, a collapsible container is comprised of a top, a bottom and a connecting bellows-like sidewall. The sidewall is comprised of one or more pairs of upper and lower hollow truncated conical sections joined at bases. The upper section apex faces, is joined to, the top. The lower section apex faces, and is joined to, the bottom at the apex of the bottom's conical section, which is shaped like the upper conical section of the sidewall. The angle of the sidewall upper conical section is slighter than the angle of the lower conical section. The length of the upper conical section is greater than the length of the lower conical section. When longitudinal axis force is applied to push the top toward the bottom, each sidewall lower conical section collapses and inverts, folding under the respective upper conical section, thus shortening the sidewall to a stable collapsed state.

In further accord with the invention, a collapsible container is comprised of a top with a circumscribing groove and a bottom having a recess with a ring around the opening thereof. When collapsed, the top of one container fits into the bottom recess of a like container, the ring and groove engaging by elasticity of the container material, so containers may be fastened top-to-bottom and stacked as assemblies. Preferably, the container has a top with an upwardly projecting conical section with a neck at the apex hereof. When axial force is applied to said container, the top conical section inverts and the neck moves within the confines of the sidewall, thus reducing the length of the top, and the corresponding necessary depth of the recess at the container bottom.

In the preferred practice of the invention, the container is made of plastic and has two pairs of sidewalls; the upper conical sections of each have angles of about 10–20 degrees with the container longitudinal axis while the lower conical sections have angles of about 15–25 degrees.

The foregoing and other objects, features and advantages of the invention will become more apparent from the following description of the best mode of the invention and accompanying drawings.

DESCRIPTION OF THE PREFERRED EMBODIMENT

The invention is described in terms of a cylindrical plastic container made by molding techniques familiarly used currently to make conventional containers.

Figure 1:
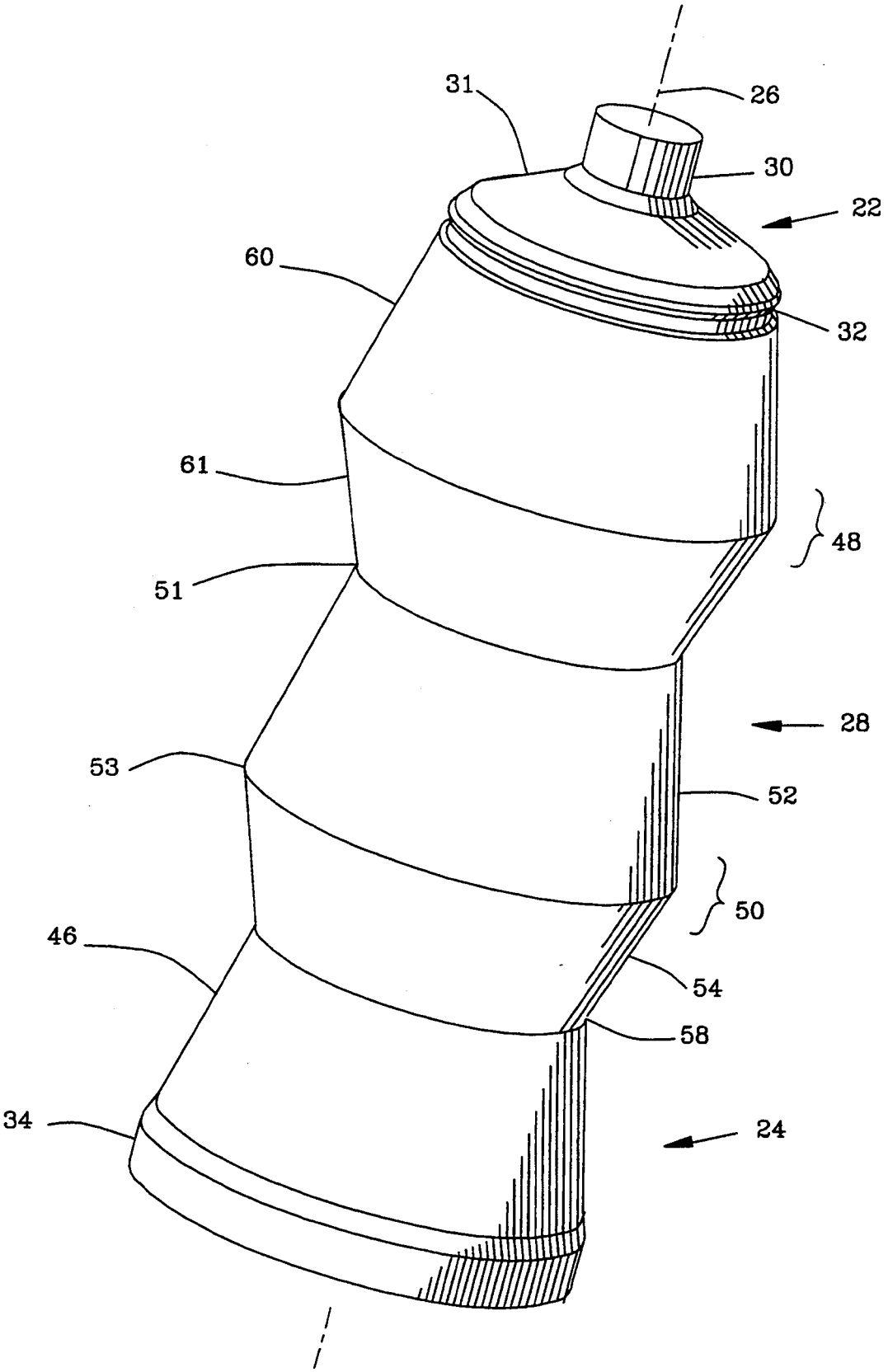
FIG. 1 is an axiometric view of a collapsible bottle container in its normal use state for containing things.

FIG. 1 shows a container having a top 22 and bottom 24 spaced apart along a longitudinal axis 26 and connected by a sidewall 28. The top has a neck or spout 30 to which a conventional closure, e.g., a screw cap, may be affixed. The top has an upward projecting conical section 31. Circumscribing the top is a groove 32. The top may have varying or non-conical section, and a variety of other configurations, as are known for conventional container tops.

Figure 2:
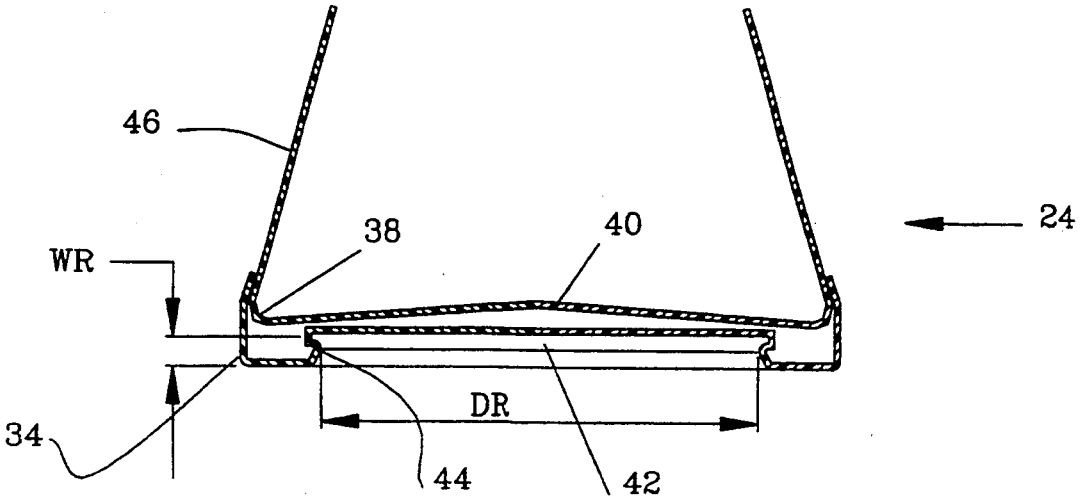
FIG. 2 is a cross section view of the base of the container of FIG. 1.

The bottom 24 has two walls and is shown in more detail in the cross section of FIG. 2. The first wall 40 is an end closure closing off the end of the sidewall to retain contents. It has a curved periphery 38 and upwardly sloped center not unlike that of many conventional bottles. The bottom has a truncated hollow conical section 46, with the apex facing toward the top 22.

Figure 3:
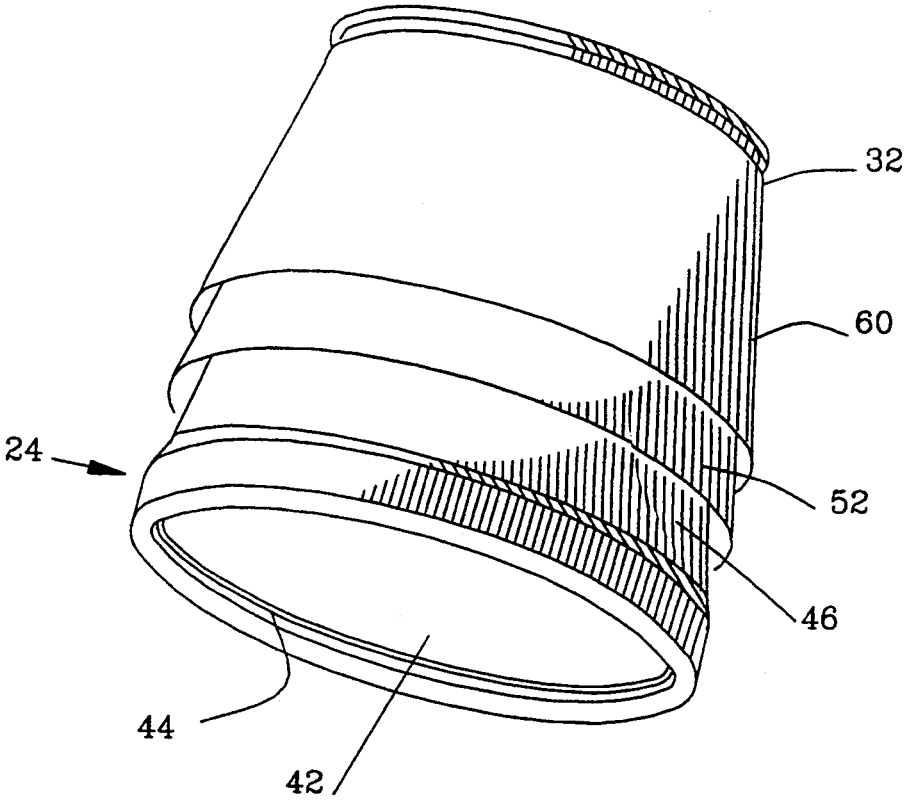
FIG. 3 shows the recess and ring at the bottom of the container (in its collapsed state).

The second bottom wall or boot 34 is attached to and circumscribes the first wall. The boot has a central recess 42 at its base as shown in FIG. 2 and 3. Around the opening of the recess is a ring 44. The ring is adapted to fit in the aforementioned groove 32 of a like container. The container may alternately of course be made with a bottom having only one wall, where the recess is molded into the one wall.

Figure 6:
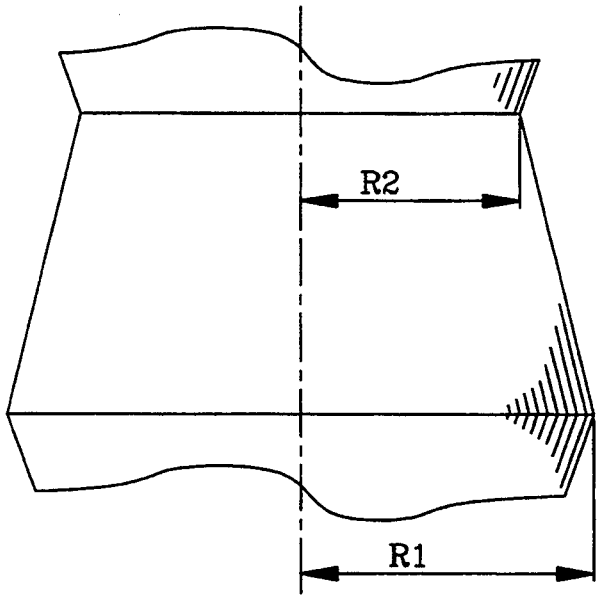
FIG. 6 shows a portion of a side elevation view of a container sidewall.

Referring again to FIG. 1, the sidewall 28 is comprised of two pairs 48, 50, of mated truncated hollow conical sections. The typical sidewall pair 50 is comprised of an upper section 52 and a lower section 54; they are attached at their matching bases 53 which have a first radius R1, as indicated by FIG. 6. The upper section 52 connects at its apex 51 to the lower section of the like conical pair 48. The apex 51 has a second radius R2 which is about 0.75 times the first radius as indicated by the proportions in FIG. 6.

The upper conical section 60 of the pair 48 connects to the top 22 adjacent the top groove 32. Thus, the preferred sidewall is comprised of two pairs of base-mated hollow cones. For each pair the lower conical section is shorter in length than is the upper conical section; and for each pair the upper section the conical wall has an angle of about 10 to 20 degrees with the longitudinal axis and the lower section conical wall has an angle of about 15 to 25 degrees. Alternatively, other angles may be used, and the pairs do not need to have identical angles and lengths, as for instance when the progression of collapsing of the sidewall might wish to be controlled.

The downward facing apex of the lower section 54 of the pair 50 attaches at joint 58 to the upward facing apex of the bottom conical section 46. The conical section 46 of the bottom has a shape like that of the upper conical sections 60, 52 of the sidewall pairs. Thus the joint 58 has the aforesaid second radius.

Figure 5:
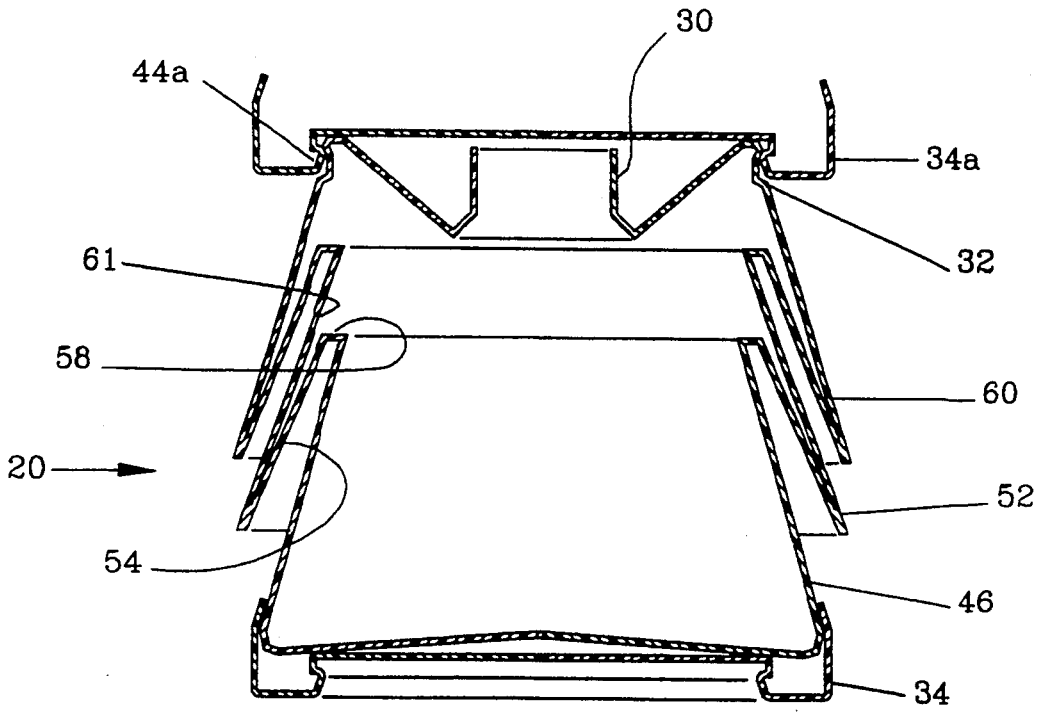
FIG. 5 shows in cross section a collapsed container, with a fragment of the bottom of a second like container, where the top and groove of the one container is held in the recess by the ring of the second container.
Figure 4:
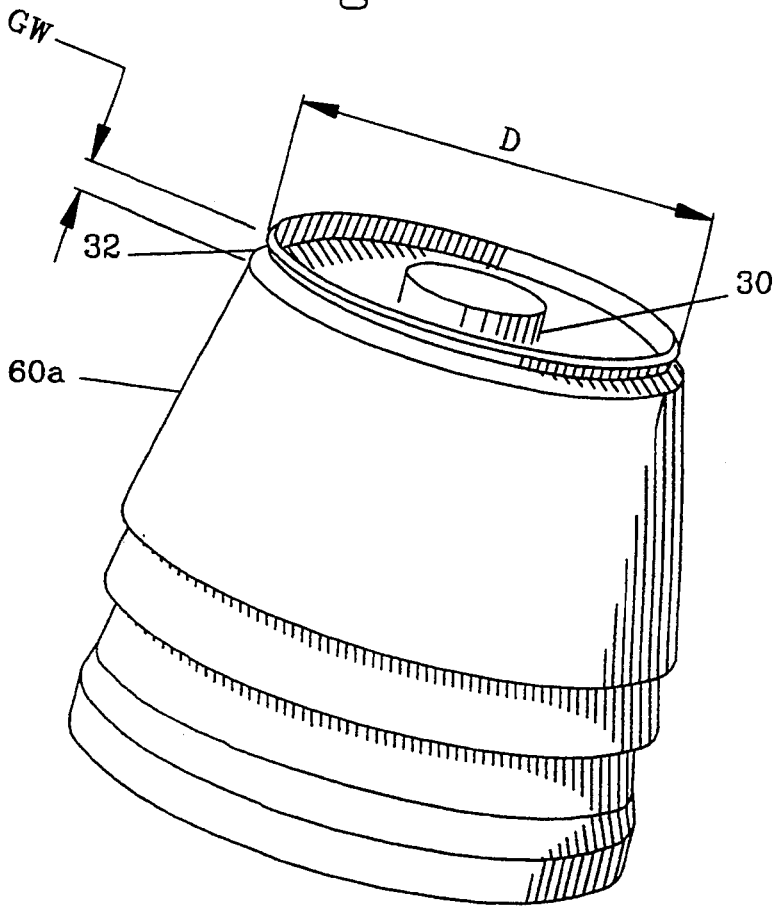
FIG. 4 shows how the top of the container collapses into the interior of the container sidewall, after force has been applied.

When sufficient longitudinal axial force is applied to press the top and bottom toward each other, two things happen: First, as illustrated by FIG. 4 and 5, the neck 30 of the top has been forced downwardly so that its uppermost portion is nominally level with the top of the groove 32; the conical section of the top has inverted to a stable position. Thus the longitudinal length of the top is reduced, facilitating its mating with the bottom of a like container, as described below. Second, the sidewall collapses and assumes the shape shown in FIG. 3–5. Each sidewall conical pair has collapsed, wherein the lower conical section has inverted and folded inside the upper conical section. This has been facilitated by the aforementioned choices of lengths and angles for the conical sections. It will be appreciated that the container in its collapsed state has assumed a stable condition, i.e., it will not tend to re-assume its original shape.

The collapsed bottles may be joined to each other by means of the top groove and bottom ring, as illustrated by FIG. 5. The bottom boot **34*a* of a like second bottle has been pressed onto the top of the bottle 20. Through elastic deformation and resilience of the plastic, the second bottle ring 44*a* has come to rest in the groove 32. The particulars of the joining together are understood by reference to FIG. 2 and FIG. 4. In accord with conventional terminology, as shown in FIG. 2 the groove 32 has a groove width GW, a groove jamor diameter D (measured at the the upwardly adjacent part of the conical section), and a groove minor diameter, being the diameter of the bottom of the groove. In FIG. 4, the ring has an inside diameter DR and a width WR (measured along the container longitudinal axis). The ring mates with the groove as shown in FIG. 5**, because the ring diameter DR is less than groove major diameter D but greater than the groove minor diameter, and because the ring width is less than the groove width. Thus, the bottles are joined to each other, top-to-bottom, as an assembly. Of course, other bottles may be likewise added to form a string or stick of bottles.

Although only the preferred embodiment has been described with some alternatives, it will be understood that further changes in form and detail may be made without departing from the spirit and scope of the claimed invention.

What is claimed is:

1. A collapsible container made of resilient plastic material comprising a top having an opening and a bottom spaced apart along a longitudinal axis, joined by a sidewall comprised of a plurality of substantially circular bellows;

the top having at its periphery a circumscribing top groove, the groove having a groove minor diameter, a groove major diameter, and a groove width, where the top joins the sidewall;

the top having an upwardly projecting truncated conical section surmounted by a neck with the top opening at the end thereof, the neck having a longitudinal axis length;

the top conical section inverting when the neck is pressed downwardly toward the base with sufficient longitudinal axis force, the extent of inversion being sufficient to cause the neck to move along the longitudinal axis toward the base a distance at least equal to the said neck longitudinal axis length, to cause the neck and inverted top conical section to become recessed within the confines of the sidewall;

the sidewall being collapsible when the container top is pressed toward the base with sufficient longitudinal axis force;

the bottom closing the end of the sidewall and having a base facing oppositely to the top and neck, the base having in its center a substantially circular shallow recess, the open end of the recess facing downwardly; the recess shaped to snugly receive the top of an identical container of which the top conical section and surmounting neck have been inverted as aforesaid; the recess having an integral ring circumscribing the opening thereof; the ring having a width, as measured along the said longitudinal container axis, less than the said groove width, and a diameter greater than said groove minor diameter and less than said groove major diameter, the ring having a smaller inside dimension than the rest of the recess, the ring dimensionally shaped to engage and fit resiliently into the top groove of an identical container, when the top of said identical container with an inverted top conical section is inserted into the recess;

wherein two identical containers are held together when the top end of a first container is pushed into the recess of the base of a second container.

2. The container of claim 1 comprising a sidewall having an upper truncated hollow conical section and a lower truncated hollow conical section, the sections connected as a pair to each other at their bases, the apex of the upper conical section facing and connected to the top; the upper conical section having a longitudinal axis length greater than the corresponding length of the lower conical section; the angle of the upper conical section with the longitudinal axis being less than the angle of the lower conical section with the longitudinal axis;

the bottom comprising an end closure having a truncated hollow conical section with the apex thereof facing toward the top and connected to the apex of the sidewall lower conical section, the bottom hollow conical section having substantially the same shape as said sidewall upper hollow conical section;

wherein, when the top is pressed toward the base with sufficient longitudinal axis force, the sidewall lower conical section folds radially inwardly; the lower conical section thereby inverting and nesting within the the upper conical section, to shorten the longitudinal length of the sidewall and container.

3. The container of claim 2 characterized by the apex of the sidewall hollow lower conical section having a radius about 0.75 times that of the radius of the base thereof.

4. The container of claim 2 characterized by the upper conical section having a side wall angle of 10 to 20 degrees from the longitudinal axis and the lower conical section having a side wall angle of 15 to 25 degrees with the longitudinal axis.

5. The container of claim 1 characterized by the bottom being comprised of a two wall structure; the first wall closing the end of the sidewall; the second wall attached to the first wall, positioned further from the top than the first wall and having the recess for receiving the top of the identical container.

6. Longitudinally and serially top-to-bottom connected assembly comprised of a multiplicity of identical containers of claim 1 in the collapsed state.

* * * * *